United States Patent [19]

Reh et al.

[11] Patent Number: 4,996,836

[45] Date of Patent: Mar. 5, 1991

[54] COMBINED GAS AND STEAM TURBINE PROCESS

[75] Inventors: Lothar Reh, Frankfurt am Main; Rolf Graf; Martin Hirsch, both of Friedrichsdorf; Ludolf Plass, Kronberg, all of Fed. Rep. of Germany

[73] Assignee: Metallgesellschaft Aktiengesellschaft, Frankfurt am Main, Fed. Rep. of Germany

[21] Appl. No.: 423,669

[22] Filed: Oct. 18, 1989

Related U.S. Application Data

[63] Continuation of Ser. No. 35,594, Apr. 7, 1987, abandoned.

[30] Foreign Application Priority Data

Apr. 17, 1986 [DE] Fed. Rep. of Germany ..... 3612888

[51] Int. Cl.[5] ..... F02C 3/28

[52] U.S. Cl. ..... 60/39.02; 60/39.12; 60/39.182

[58] Field of Search ..... 60/39.02, 39.12, 39.182; 110/347; 122/4 D; 431/7

[56] References Cited

U.S. PATENT DOCUMENTS

| | | | |
|---|---|---|---|
| 3,086,362 | 4/1963 | Foster-Pegg | 60/39.12 |
| 3,986,348 | 10/1976 | Switzer | 60/39.12 |
| 3,991,557 | 11/1976 | Donath | 60/39.12 |
| 4,111,158 | 9/1978 | Reh et al. | 122/4 D |
| 4,165,717 | 8/1979 | Reh et al. | 122/4 D |
| 4,444,568 | 4/1984 | Beisswenger et al. | 48/197 R |
| 4,470,255 | 9/1984 | Rowlands et al. | 60/39.12 |
| 4,478,039 | 10/1984 | Horgan | 60/39.02 |

FOREIGN PATENT DOCUMENTS

| | | |
|---|---|---|
| 3338107 | 10/1983 | Fed. Rep. of Germany . |
| 83085 | 9/1982 | Luxembourg . |
| 2148734 | 6/1985 | United Kingdom . |

OTHER PUBLICATIONS

Patent Abstracts of Japan, Band 6, Nr. 126 (M-142) 1004, 10, Jul. 1982; & JP-A-57 52 707 (Babcock Hitachi K.K.), 29-03-1982.

Patent Abstracts of Japan, Band 9, Nr. 87 (M-372), 1810, 17, Apr. 1985; & JP-A-59 215 906 (Ishikawajima Harima Jukogyo K.K.), 05-12-1984.

K. Weinzierl, "Kohlevergasung zur Wirkungsgradverbesserung im Kraftwerk", VGB-Kraftwerkstechnik 62 (1982), No. 5, p. 365 et. seq., and No. 10, p. 852 et seq).

*Primary Examiner*—Louis J. Casaregola

*Attorney, Agent, or Firm*—Felfe & Lynch

[57] ABSTRACT

Disclosed is a process of carrying out a combined gas turbine and steam turbine process of increased efficiency.

A fuel gas is produced at a temperature of from 900° to 1100° C. in a circulating fluidized bed by a gasification of 70 to 95 wt. % of the carbon contained in the carbonaceous material and is treated at a temperature of from 850° to 950° C. with suspended solids consisting of calcium hydroxide, calcium oxide and/or calcium carbonate-containing solids to remove pollutants. The main portion of the fuel gas is burnt to produce a gas which is used to operate the gas turbine and which contains at least 5% by volume oxygen and is at a temperature of at least 1000° C. Combustion of the carbonaceous gasification residue to produce process steam is performed in a second circulating fluidized bed at a temperature of from 800° to 950° C. under near-stoichiometric conditions by a treatment with oxygen-containing gases, which are supplied on different levels in at least two partial streams and mainly consist of exhaust gas from the gas turbine. The desulfurized fuel gas is preferably cooled to a temperature in the range from 350° to 600° C. and is freed from halides.

4 Claims, 1 Drawing Sheet

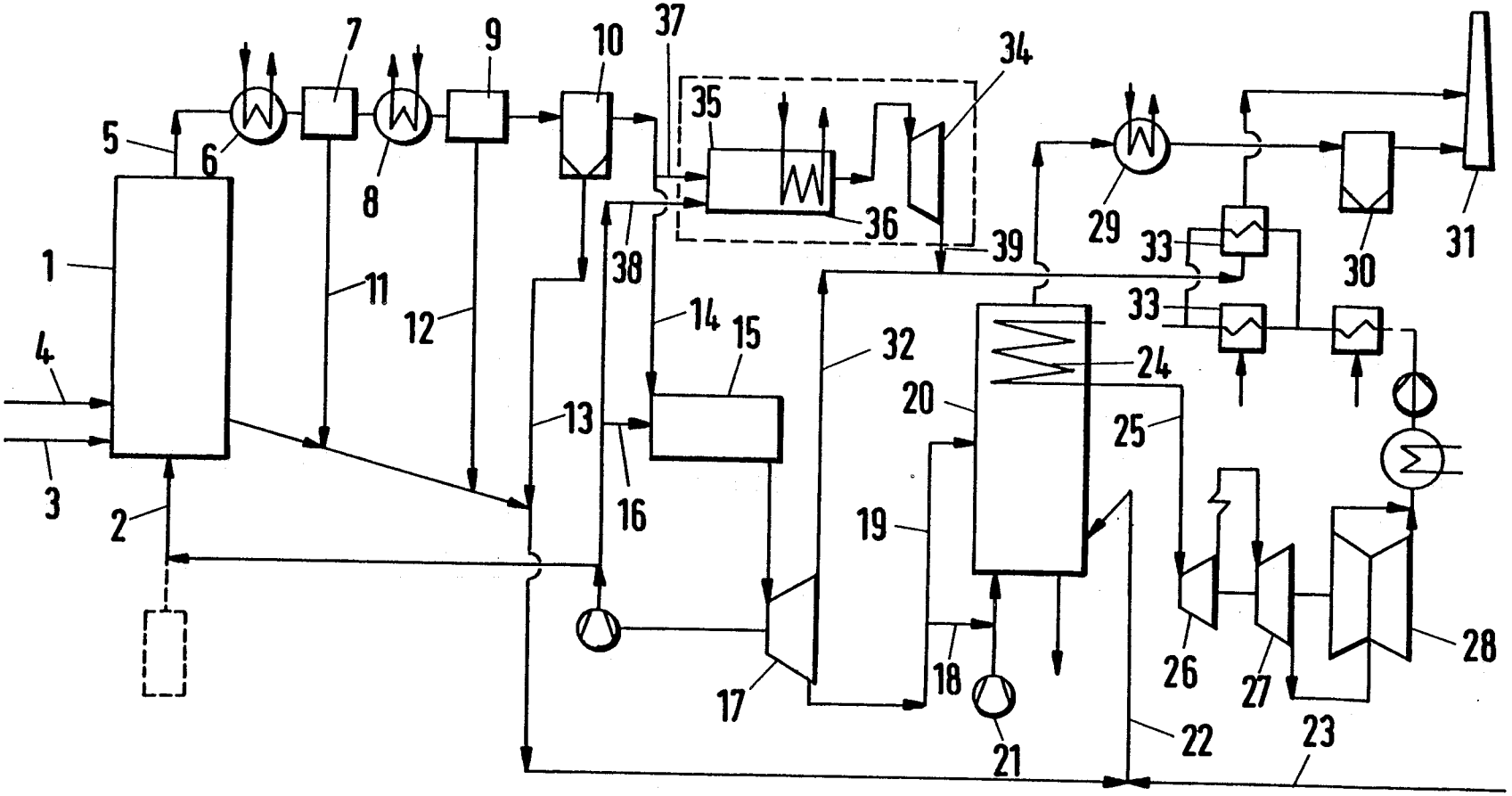
1
2
3
4
5
6
7
8
9
10
11
12
13
14
15
16
17
18
19
20
21
22
23
24
25
26
27
28
29
30
31
32
33
33
34
35
36
37
38
39

COMBINED GAS AND STEAM TURBINE PROCESS

This application is a continuation of application Ser. No. 035,594, filed Apr. 7, 1987, now abandoned.

BACKGROUND OF THE INVENTION

The present invention is in a process of carrying out a combined gas turbine and steam turbine process in which the gas turbine process is carried out with a fuel gas which has been produced from solid carbonaceous material and has subsequently been desulfurized, the steam turbine process is carried out with steam which has been produced by the heat generated by the combustion of the carbonaceous gasification residue, and the carbonaceous combustion residue is burnt with oxygen-containing exhaust gases from the gas turbine process.

The energy crises has given rise in recent years to an increasing trend to replace oil and gas by solid fuels, particularly coal, in the generation of electric power. In the production of electric power from solid fuels, greater efforts also have been made to increase the efficiency and the recovery of thermal energy from such fuels in such a manner that the primary energy source is utilized to a higher degree while meeting the more stringent environmental protection requirements. It is known that an increase of the efficiency will result in a decrease of the quantity of pollutant emitted per unit of energy which is produced if given means are used to purify the exhaust gases.

In the production of electric power, improved efficiencies can be achieved by adopting measures in consideration of thermodynamics, particularly in combined gas turbine and steam turbine processes. Whereas a gas turbine may be gas- or oil-fired for that purpose, to achieve a decisive advantage one must supply the gas turbine with a gas which has been produced by a partial gasification of solid fuel.

For instance, in the coal conversion process of VEW, coal is partly gasified in a gasifier, the pollutants are scrubbed from the resulting gas and the scrubbed gas is subsequently burnt in the gas turbine. The coke left after the partial gasification is burnt in the furnace of a steam generator with the oxygen-containing exhaust gases from the gas turbine and the resulting steam is supplied to a steam turbine (K. Weinzierl, "Kohlevergasung zur Wirkungsgradverbesserung im Kraftwerk", VGB-Kraftwerkstechnik 62 (1982), No. 5, pages 365 et seq., and No. 10, pages 852 et seq.).

Whereas the above-mentioned concept of the combined gas turbine and steam turbine process appears to be only attractive at first sight, problems are involved in the technology of the several process steps and in their combination. It must be borne in mind that even drawbacks or disadvantages which affect only details of the process may eliminate the improvement of the efficiency achievable in the process. For instance, a relatively high temperature gasification has the disadvantage that valuable gas produced in the process is spent for air preheating, which is required for the high gasification temperature. Because the gasification temperature and, as a result, also the gas temperature, is high, an appreciable quantity of sensible heat must be extracted from the produced gas. This is usually accomplished by a production of superheated steam, which is supplied to the steam turbine. As a result, the above-mentioned design of the gasification stage involves a shifting of energy from the gas turbine stage to the steam turbine stage and thermodynamic considerations show that a substantial part of the improvement in efficiency is thus consumed.

Another problem is involved in the combustion, for instance, when it is not possible to burn as completely as possible the carbon which is contained in the gasification residue. Great problems, which may also adversely affect the efficiency, are also involved in the desulfurization of the fuel gases produced by the gasification and of the flue gases derived from said fuel gases as well as the flue gases produced by the burning of the residue.

EP-A1-62 363 discloses subjecting carbonaceous material in a first stage to a gasification under a pressure of up to 5 bars and at a temperature from 800° to 1100° C. by a treatment with oxygen-containing gases in the presence of water vapor in a circulating fluidized bed to convert 40 to 80% by weight of the carbon contained in the starting material. Sulfur compounds are removed from the resulting gases at a temperature in the range from 800° to 1000° C. in a suspension. The gas is then cooled and subjected to dust collection, and in a second stage the gasification residue and the by-products obtained by the purification of the gas, such as laden desulfurizing agent, dust, and gas liquor, are supplied to a second circulating fluidized bed, in which the remaining combustible constituents are burnt with an air excess of 1.05 to 1.40 of the stoichiometric demand.

But that proposal has been made with the object to provide power in various forms for the industrial production of certain products, e.g., to provide power in the form of steam for heating purposes or in the form of different fluids at high temperature and in the form of clean fuel gases, which can be burnt without adversely affecting the quality of the product. The degree to which the primary energy (e.g., of coal) is converted to the secondary energy sources consisting of fuel gas and process heat should be variable within wide limits in adaptation to the instantaneous demand for secondary energy in one form or another. This means that the problem solved by the known process outlined hereinbefore does not arise in that form in combined gas turbine and steam turbine processes. This is apparent, inter alia, from the different degrees of gasification.

SUMMARY OF THE INVENTION

It is an object of the invention to provide a combined gas turbine and steam turbine process which is free of the disadvantages of the known processes, particularly of the known process discussed hereinbefore, and which permits an ecologically satisfactory combustion of solid carbonaceous fuels with a high recovery of thermal energy from the fuel and the high efficiency production of electric power.

This object and others are accomplished in that the process of the invention is carried out in such a manner that the fuel gas is produced at a temperature of from 900° to 1100° C. in a circulating fluidized bed by a gasification of 70 to 95% by weight of the carbon contained in the carbonaceous material and is treated at a temperature from 850° to 950° C. with suspended solids consisting of calcium hydroxide, calcium oxide and/or calcium carbonate-containing solids to remove pollutants. The main portion of the fuel gas is burnt to produce a gas which is used to operate the gas turbine and which contains at least 5% by volume oxygen and is at a temperature of at least 1000° C. The carbonaceous gasification residue is combusted to produce process steam. This combustion is carried out in another circulating fluidized bed at a temperature of from 800° to 950° C. under near-stoichiometric conditions by a treatment with oxygen-containing gases, which are supplied on different levels in at least two partial streams and mainly consist of exhaust gas from the gas turbine. Near stoichiometric conditions mean the use of an air excess of 1.05 to 1.40 of the stoichiometric demand.

In the process in accordance with the invention the term "solid carbonaceous material" describes a fuel which is solid at ambient temperature. Such materials include, e.g., coals of all kinds, inclusive of washery refuse and coke, and also petroleum coke, wood waste, peat, oil shale, asphaltenes and refinery residues.

From an "orthodox" fluidized bed, in which a dense phase is separated by a distinct step in density from the overlying gas space, a circulating fluidized bed such as is used in the gasification and combustion stages differs in that it exhibits states of distribution without a defined boundary layer. There is no step in density between a dense phase and an overlying gas space but the solids concentration in the reactor decreases from bottom to top.

The definition of the operating conditions by the numbers of Froude and Archimedes results in the following ranges:

$$0.1 \leqq 3/4 \times Fr^2 \times \frac{\rho_g}{\rho_k - \rho_g} \leqq 10$$

and $$0.01 \leqq Ar \leqq 100$$

wherein $$Ar = \frac{d_k^3 \times g(\rho_k - \rho_g)}{\rho_g \times \nu^2}$$

$$Fr^2 = \frac{u^2}{g \times d_k}$$

and u=relative gas velocity in m/s
Ar=Archimedes number
Fr=Froude number
$\rho_g$=density of gas in kg/m$^3$
$\rho_k$=density of solid particle in kg/m$^3$
$d_k$=diameter of spherical particles in m
$\gamma$=kinematic viscosity in m$^2$/s
g=gravitational constant in m/s$^s$ Supplemental information on the operation of circulating fluidized beds is apparent from L. Reh et al, "Wirbelschichtprozesse für die Chemie- und Hüttenindustrie, die Energieumwandlung und den Umweltschutz", Chem.-Ing. Techn. 55 (1983), No. 2, pages 87 to 93.

The produced gas can be desulfurized with suspended solids in any desired unit, e.g., in a pneumatic conveyor or in a venturi fluidized bed, from which solids are discharged into a succeeding separator. Advantageously, a circulating fluidized bed also can be used for the desulfurization.

If the gasification can be effected below 1000° C., e.g., because fuel gases having a relatively low heating value are permissible in the gas turbine, the desulfurization can be effected in the gasification reactor, i.e., in situ.

The gasification can be effected under any pressure which is deemed suitable in a given case. That pressure will usually be selected in consideration of the operating conditions in the gas turbine and will lie approximately in the range of from 15 to 30 bars. From thermodynamic aspects, the pressure should be as high as possible.

The oxygen-containing gas required for the gasification and the water vapor which is usually required should be supplied to the fluidized bed reactor of the gasification stage on different levels. It is desirable to supply water vapor mainly in the form of fluidizing gas and to supply oxygen-containing gas mainly in the form of secondary gas. It will be understood that a minor quantity of water vapor may be supplied together with the oxygen-containing secondary gas and a minor quantity of oxygen-containing gas may be supplied together with water vapor supplied as fluidizing gas.

The residence time of the gases in the gasification stage—above the entrance for the carbonaceous material—should be of the order of 3 to 20 seconds, preferably 10 to 15 seconds. That requirement is usually met in that the carbonaceous material is charged into the gasification stage on a higher level. This will result in the production of a hydrocarbon rich gas which has a correspondingly higher heating value and insure that the gas is substantially free of hydrocarbons, which could condense in the exhaust gas system.

The desulfurizing agents used to desulfurize the fuel gas suitably have a particle size $d_p50$ of 5 to 200 $\mu$m. In the fluidized bed reactor, a mean suspension density of 0.1 to 10 kg/m$^3$, preferably of 1 to 5 kg/m$^3$, should be maintained and the weight of solids circulated per hour should be at least 5 times the weight of solids contained in the shaft of the reactor.

The desulfurizing agent is supplied at a rate which is at least 1.2 to 2.0 times the rate which is stoichiometrically required in accordance with the equation $$CaO + H_2S \rightarrow CaS + H_2O$$

It should be borne in mind that where dolomite or burnt dolomite is employed, virtually only the calcium compound will react with the sulfur compounds. Besides, the quantity of effective desulfurizing agent which is introduced with the inorganic constituents of the carbonaceous material must be taken into account in connection with a desulfurization in situ in the gasification reactor.

The gas velocity during the desulfurization will be selected in dependence on the gas pressure and will amount to about 1 to 5 m/sec. (calculated as empty-pipe velocity).

If the fuel gas is separately desulfurized and particularly if the fuel gas leaving the gasification stage is at a high temperature, all desulfurizing agent, including that which is required in the combustion stage, can be added to the stage in which the gas is desulfurized. In that case the thermal energy which is required for heating and for an optional de-acidification will be extracted from the gas and will thus be conserved in the gasification and combustion stages.

Those combustible constituents not converted in the gasification stage are regarded as a difficult fuel, particularly from the perspective of an ecologically satisfactory combustion. The by-products, resulting from the purification of the gas, are also difficult to process.

They are desirably processed in another circulating fluidized bed so that the by-products from the gas purification are eliminated in an ecologically satisfactory manner. The laden desulfurizing agent from the gas purification stage, particularly those desulfurizing agents which consist of sulfides, such as calcium sulfide, are converted to disposable sulfates, such as calcium sulfate. The heat of oxidation which is liberated during the sulfation can be used to produce additional steam. Other by-products, such as dust collected from the gas, are also transformed to ecologically satisfactory products.

The combustion is effected in two stages with oxygen-containing gases supplied on different levels resulting in a "soft" combustion. This will eliminate local overheating. The staged combustion substantially suppresses formation of $NO_x$ to a large degree. Fuel is supplied to the zone between the inlets for the oxygen-containing fluidizing and secondary gases. The rates of fluidizing and secondary gases are suitably selected to provide a mean suspension density of 15 to 100 kg/m$^3$ above the uppermost gas inlet. A substantial portion of the heat of combustion can be dissipated by cooling surfaces disposed above the uppermost gas inlet and in contact with the solids of the bed.

Such a mode of operation has been described in detail in German Patent Publication No. 25 39 546 and U.S. Pat. No. 4,165,717.

The gas velocities maintained in the fluidized bed reactor above the secondary gas inlet usually exceed 5 m/sec (free shaft velocity) under atmospheric pressure and may amount to as much as 15 m/s. The ratio of the diameter to the height (D/H) of the fluidized bed reactor is selected to provide a fluidizing gas residence time of from 0.5 to 8.0 seconds, preferably 1 to 4 seconds.

The fluidizing gas may consist of virtually any gas which does not adversely affect the quality of the exhaust gas. Whereas inert gases may be used, such as recycled flue gas (exhaust gas), nitrogen and water vapor, it is particularly desirable for an intense combustion process to use an oxygen containing fluidizing gas.

A choice can be made between the following alternatives:

1. An oxygen-containing gas is used as a fluidizing gas. That mode of operation is usually preferable. In that case it is sufficient to supply secondary gas on one level only. Of course, secondary gas may be supplied on a plurality of levels, too.

2. An inert gas is used as a fluidizing gas. In that case the oxygen-containing combustion gas supplied as a secondary gas must be supplied on at least two superimposed levels.

The secondary gas is preferably admitted through a plurality of inlet openings on each level on which it is supplied.

The combustion process can suitably be carried out in such a manner that the fluidizing and secondary gases are supplied at such rates that a mean suspension density of 10 to 40 kg/m$^3$ is obtained above the uppermost gas inlet, hot solids are withdrawn from the circulating fluidized bed and are cooled in a fluidized state by direct and indirect heat exchanges, and at least a partial stream of cooled solids is recycled to the circulating fluidized bed. This embodiment is explained in detail in Published German Application No. 26 24 302 and in U.S. Pat. No. 4,111,158.

In that case a constant temperature can be obtained virtually without a change of the operating conditions in the fluidized bed reactor, i.e., without a change of the suspension density and other parameters, only by a controlled recycling of the cooled solids. A higher or lower recirculation rate will be adopted in dependence on the combustion rate and the selected combustion temperature. The combustion temperatures may lie between about 650° and 950° C. and may be selected as desired between very low temperatures closely above the ignition limit and very high temperatures, which are limited, e.g., by a softening of the combustion residues.

In that embodiment of the invention the gas residence time, gas velocities above the secondary gas inlet during operation under atmospheric pressure, and the manner in which the fluidizing and secondary gases are supplied, will be the same as the corresponding parameters of the embodiment described before.

Without a change in the gasification stage, the rate of steam production can be increased by a supply of additional carbonaceous material to the combustion stage. Because solid carbonaceous material can separately be supplied to the combustion stage, the steam turbine operation can be started, particularly during the running-up phase, independently of the availability of gasification residue from the gasification stage.

The oxygen-containing gas may consist of air, oxygen-enriched air or commercially pure oxygen. The combustion stage can be operated under atmospheric pressure or under a superatmospheric pressure up to about 10 bars.

In preferred embodiments of the invention, the fuel gas is produced by a gasification of at least 80% by weight of the carbon contained in the solid carbonaceous material and/or the desulfurized fuel gas is cooled to a temperature in the range of from 350° to 600° C. and is freed from halides.

The increase of the degree of gasification to at least 80% by weight usually affords the advantage that the efficiency is increased further.

The halides are removed in a dry process by a treatment with calcium oxide and/or calcium hydroxide basically under the same process conditions which have been stated for the separate desulfurization of the fuel gases.

The main portion of the fuel gas, which has been produced and purified in the manner described hereinbefore, is burnt in a combustion chamber in the presence of an excess of oxygen to produce flue gases having a low $NO_x$ content and containing at least 5% by volume oxygen. Because the temperature of the flue gas must be selected in consideration of the operating conditions of the gas turbine and the highest permissible value will usually be selected for an operation under full load, the oxygen-containing gases required for the combustion will be supplied at such a rate that the highest permissible temperature is obtained, provided that the oxygen content of the flue gas of at least 5% by volume is obtained. It may be necessary to insure that the fuel gas has a sufficiently high heating value. In the present practice the operating temperatures of the gas turbine are not in excess of 1200° C.

In another preferred embodiment of the invention, any remaining portion of the fuel gas is burnt under approximately stoichiometric conditions to produce low-$NO_x$ flue gases, which are cooled and then supplied to a second gas turbine. For the reasons stated hereinbefore, the cooled flue gases should approach the highest permissible entrance temperature of the gas turbine as closely as possible.

That embodiment of the invention affords the special advantage that a high efficiency can be obtained even during an operation under a partial load.

If oxygen-enriched air or commercially pure oxygen is used for the gasification and/or combustion and an air-separating plant is available to produce the oxygen, it is recommended to supply that combustion chamber or chambers used to produce the flue gases for the gas turbine or gas turbines with at least part of the nitrogen which is formed by the separation of air. This will provide for the gas turbine process an additional gas volume, which has been formed by the transfer of heat of combustion from the fuel gases so the efficiency can be improved. But when the fuel gases are cooled with nitrogen, care must be taken that the cooled gases approach the highest permissible entrance temperature as closely as possible.

The degree to which the primary energy, such as coal, is converted to fuel gas and steam, will determine the overall efficiency of the combined gas turbine and steam turbine process and will substantially depend on the highest permissible temperature of the flue gas entering the gas turbine. For instance, the gas turbine to steam turbine output power ratio will increase in favor of the gas turbine as the permissible flue gas entrance temperature is increased. For this reason, as the highest permissible entrance temperature of the flue gases is increased, the degree of gasification should be increased and the degree of residue combustion should be decreased. Efficiencies of about 45% can be achieved with flue gas entrance temperatures of 1200° C.

The various features of novelty which characterize the invention are pointed out with particularity in the claims annexed to and forming a part of this specification. For a better understanding of the invention, its operating advantages and specific objects obtained by its use, reference should be had to the accompanying drawing and descriptive matter in which there is illustrated and described a preferred embodiment of the invention.

BRIEF DESCRIPTION OF THE DRAWING

The drawing schematically illustrates a process according to the invention.

DESCRIPTION OF PREFERRED EMBODIMENT

Referring to the drawing, fuel gas is produced in a circulating fluidized bed 1, which is supplied with oxygen-containing fluidizing gas through line 2, with steam through line 3 and with coal through line 4. The fuel gas is delivered in line 5 to a first heat exchanger 6 and from the latter to a desulfurizer 7. When the fuel gas has then passed through a second heat exchanger 8, hydrohalides, particularly hydrogen chloride, are removed in halide seperator 9. Dust is collected in precipitator 10. The sorbents, which have been used in the units 7 and 9 and are laden with pollutants, are removed from the fuel gas. Dust collected in the unit 10 is withdrawn through lines 11, 12 and 13, respectively.

The fuel gas is then introduced via line 14 into combustion chamber 15, which is supplied with oxygen-containing gas through line 16. The flue gas for driving the gas turbine 17 is produced in the combustion chamber 15 by a combustion in the presence of an excess of oxygen. The oxygen-containing gas is supplied at such a rate that the optimum temperature of the flue gas for the operation of the gas turbine 17 is obtained.

A portion of the exhaust gas from gas turbine 17 is supplied as fluidizing gas through line 18 and as secondary gas through line 19 to circulating fluidized bed 20, in which the gasification residue is burnt. Any fresh oxygen-containing fluidizing gas which may be required is supplied by fan 21. The gasification residue, the laden sorbents and the dusts collected from the fuel gases are charged into the circulating fluidized bed 20 through line 22. Additional desulfurizing agent and, if desired, additional coal can be supplied to the circulating fluidized bed 20 through line 23.

Steam is produced in the steam registers 24 of the circulating fluidized bed 20 and is supplied through line 25 to the steam turbine stages 26, 27 and 28, which are operated under high, medium and low pressures, respectively. The exhaust gas from the circulating fluidized bed 20 is conducted through a further heat exchanger 29, a dust-collecting plant 30 and into stack 31.

Any oxygen-containing flue gas, which has left the gas turbine 17 and is not required in the circulating fluidized bed 20, can be supplied in line 32 to a heat exchanger system 33, cooled therein in the usual manner, and subsequently delivered to stack 31.

The area surrounded by broken lines contains a second gas turbine 34, which is desirably operated particularly during an operation under a partial load. The gas turbine 34 is preceded by a combustion chamber 35, which has a waste heat boiler 36 associated with it or may consist of a combustion chamber having cooled walls. The operation of the gas turbine 34 differs from that of the gas turbine 17 in that the gas turbine 34 is operated with a flue gas produced by a near-stoichiometric combustion from fuel gas supplied through line 37 and oxygen-containing gas supplied through line 38. The exhaust gas from the gas turbine 34 is conducted through line 39 to line 32 and is utilized in the manner described hereinbefore.

The generators associated with the turbines are not shown on the drawing for the sake of clarity. However, their presence will be understood by those skilled in the art.

EXAMPLE 1

Gas at a rate of 223,000 $Nm^3/h$ is produced in the circulating fluidized bed 1, which is supplied through line 2 with air at 350° C. and 20 bars at a rate of 155,000 $Nm^3$, through line 3 with steam at 400° C. at a rate of 3,900 kg/h, and through line 4 with bituminous coal having an average particle size below 6 mm at a rate of 70,000 kg/h. The bituminous coal contains 35% by, weight volatiles (on a water- and ashfree basis) and has the following composition:

21.5% by weight ash
1.5% by weight water
70.5% by weight C+H
2.0% by weight N+S
4.5% by weight O and a lower heating value $H_u$ of 26 MJ/kg. The temperature in the gasification stage is 1050° C. and the conversion of carbon is 85% by weight.

The gas which is produced is withdrawn through line 5 and is cooled to 900° C. in the heat exchanger 6 and desulfurized in the unit 7 by an addition of $CaCO_3$ at a rate of 5,000 kg/h. Thereafter the gas has the following composition:

24.4% by volume CO
4.0% by volume $CO_2$ 11.3% volume $H_2$
3.0% by volume $H_2O$
2.4% by volume $CH_4+C_mH_n$
54.9% by volume $N_2$
and a lower heating value of 5.3 kJ/Nm$^3$.

When the gas has been cooled further to 400° C. in the heat exchanger 8 and remaining polluting gases, particularly HCl, have been removed to contents below 10 mg/sm$^3$ by treatment with $Ca(OH)_2$ in unit 9, dust is collected from the gas to a dust content below 10 mg/sm$^3$ in unit 10.

The gas is then supplied through line 14 to the combustion chamber 15 and is burnt therein with air which is supplied through line 16 at a rate which is 3.6 times the rate which is stoichiometrically required. The resulting flue gas at 1100° C. is subsequently expanded in the gas turbine 17. The exhaust gas from the gas turbine is at a temperature of 550° C. and a pressure of 1.35 bars and contains 13% by volume oxygen and 200 mg $NO_x$ per sm$^3$. The generator associated with the gas turbine 17 has an output power of 97 MW.

The gasification residue of 26,700 kg/h is mixed with 5,000 kg/h in total of solids withdrawn from the units 7, 9 and 10. The resulting mixture is supplied in line 22 at a temperature of 955° C. to the circulating fluidized bed 20 and is burnt therein at 850° C. in the presence of an excess of 25% oxygen. The volume ratio of fluidizing gas to secondary gas is 30:70. The fluidizing gas is at a temperature of 300° C. and is composed of a one-third share consisting of air (fan 21) and of a two-thirds share consisting of exhaust gas supplied from the gas turbine 17 through line 18. The secondary gas for the fluidized bed reactor 20 is at a temperature of 550° C. and consists only of exhaust gas supplied in line 19 from the gas turbine 17. A total of 10% by volume of the exhaust gas from the gas turbine 17 is supplied to the circulating fluidized bed 20. Steam at 100 bars and 535° C. is produced in the circulating fluidized bed 20 and is supplied through line 25 to the steam turbine 26, 27, 28. The generator associated with said steam turbine produces a net power of 116 MW.

The exhaust gas from the circulating fluidized bed 20 is cooled in the heat exchanger 29. Dust is collected from the cooled gas in unit 30 and the gas is then delivered to the stack 31. Due to the favorable combustion conditions, the gas contains less than 175 mg $NO_x$ per sm$^3$ and less than 200 mg $SO_x$ per sm$^3$.

That part (90% by volume) of the exhaust gas from the gas turbine 17 not utilized in the combustion process is delivered through line 32 to the heat exchanger system 33 and is cooled therein to 100° C. with condensate preheating and steam production and is finally delivered to the stack 31.

An overall efficiency of 42% is achieved in this example, in which the ratio of the output powers of the steam and gas turbines is about 1:0.83.

EXAMPLE 2

The gasification, gas cooling and gas purification are performed under the same conditions and at the same rates as in Example 1.

40% of the fuel gas produced in the gasification stage 1 is burnt in the superatmospheric combustion chamber 35 with an air excess of 5% to form a flue gas at 1100° C., which is expanded in the gas turbine 34. The exhaust gas from the gas turbine 34 is at a temperature of 550° C. and a pressure of about 1 bar and contains about 1% by volume oxygen. That gas is cooled in the heat exchanger system 33 and delivered to the stack 31 at a temperature of about 100° C.

The generator associated with the gas turbine 34 has an output power of 26 MW.

The remaining 60% of the fuel gas, i.e., a major part thereof, is supplied through line 14 to the combustion chamber 15 and is burnt therein in the presence of air in an amount which is 3.6 times the amount which is stoichiometrically required. The resulting flue gas at 1100° C. is subsequently expanded in the gas turbine 17 and is thus cooled to 550° C. The exhaust gas from the gas turbine 17 contains 13% by volume oxygen and is under a pressure of 1.35 bars.

The generator associated with the gas turbine 17 has an output power of 58 MW.

The gasification residue at a rate of 26,700 kg/h and the solids withdrawn from the units 7, 9 and 10 at a total rate of 5,000 kg/h are supplied through line 22 to the circulating fluidized bed 20 and are burnt therein at 850° C. with an oxygen excess of 25%. As in Example 1, the ratio of the volumes of fluidizing gas and secondary gas is 30:70 and the fluidizing gas has a temperature of 300° C. and is composed of a one-third share consisting of air (fan 21) and a two-thirds share consisting of exhaust gas delivered from gas turbine 17 through line 18. The secondary gas for the fluidized bed reactor 20 consists only of exhaust gas, which is delivered at a temperature of 550° C. in line 19 from the gas turbine 17. It is apparent that a total of 17% by volume of the exhaust gas from gas turbine 17 is supplied to the circulating fluidized bed 20.

Steam at 100 bars and 535° C. is produced in the circulating fluidized bed 20 and is supplied through line 25 to the steam turbine 26, 27, 28. The generator associated with that steam turbine has a net output power of 129 MW.

The exhaust gas from the circulating fluidized bed 20 and the gas turbine exhaust gas which is not used in the combustion process are conducted as in Example 1.

An overall efficiency of 42% is achieved also in the present Example.

It will be understood that, the specification and examples are illustrative but not limitative of the present invention and that other embodiments within the spirit and scope of the invention will suggest themselves to those skilled in the art.

We claim:

1. A process for producing power in a combined gas turbine and steam turbine process, comprising:

introducing a solid carbonaceous material into a circulating fluidized bed;

gasifying 70 to 95 wt.-% of the carbon to produce a fuel gas at a temperature of 900°–1100° C. and a carbonaceous gasification residue;

removing pollutants from said fuel gas at a temperature of 850° to 950° C. by suspending therein solids containing at least one of $Ca(OH)_2$, CaO and $CaCO_3$;

combusting at least a portion of the fuel gas to produce a flue gas which contains at least 5% by volume of oxygen and is at a temperature of at least 1000° C.;

expanding the flue gas in a gas turbine to generate power;

exhausting an exhaust gas from the turbine;

generating heat by combusting the carbonaceous gasification residue in a second circulating fluidized bed at a temperature of from 800° to 950° C. under near-stoichiometric conditions with oxygen containing gases, said oxygen containing gases being supplied to the circulating fluidized bed at different levels in at least two partial streams, said gases including the exhaust gas from said gas turbine;

producing steam with the heat generated by the combustion of the gasification residue; and introducing said steam into a steam turbine to generate power.

2. The process of claim 1 wherein the treated fuel gas is cooled to a temperature in the range of from 350° to 600° C. and is freed of halides.

3. The process of claim 1 wherein any remaining fuel gas is burnt under near-stoichiometric conditions and the resulting flue gas is cooled and supplied to a second gas turbine.

4. The process of claim 1 wherein the fuel gas is produced by a gasification of at least 80% by weight of the carbon contained in the carbonaceous material.

* * * * *